US008985374B2

(12) United States Patent
Tsai

(10) Patent No.: US 8,985,374 B2
(45) Date of Patent: Mar. 24, 2015

(54) OBJECT CARRYING DEVICE

(75) Inventor: Tsung-Yu Tsai, Changhua County (TW)

(73) Assignee: Dongguan Master United Plastic & Hardware Products Co., Ltd, Dongguan, Guandong Province (CN)

( * ) Notice: Subject to any disclaimer, the term of this patent is extended or adjusted under 35 U.S.C. 154(b) by 134 days.

(21) Appl. No.: 13/611,813

(22) Filed: Sep. 12, 2012

(65) Prior Publication Data

US 2014/0069913 A1 Mar. 13, 2014

(51) Int. Cl.
*B65D 6/08* (2006.01)

(52) U.S. Cl.
CPC ..... *B65D 7/20* (2013.01)
USPC ..... 220/485; 220/4.28; 220/491; 220/642; 312/348.1

(58) Field of Classification Search
USPC ..... 220/4.28, 9.1–9.4, 491, 493, 494, 220/485–486, 607, 642; 211/126.15, 71.01; 312/348.1, 348.4, 330.1; 383/117
See application file for complete search history.

(56) References Cited

U.S. PATENT DOCUMENTS

| | | | | | |
|---|---|---|---|---|---|
| 2,502,781 | A * | 4/1950 | Erickson | 220/491 |
| 3,935,958 | A * | 2/1976 | Frangos | 220/488 |
| 4,852,741 | A * | 8/1989 | Van Benschoten | 206/558 |
| 5,819,933 | A * | 10/1998 | Hernandez | 206/373 |
| D434,074 | S * | 11/2000 | Hardy | D19/75 |
| 6,508,376 | B1 * | 1/2003 | Chiang | 220/485 |
| 6,712,436 | B2 * | 3/2004 | Chen | 312/348.1 |
| 6,726,045 | B1 * | 4/2004 | Chen et al. | 220/4.34 |
| 6,726,362 | B1 * | 4/2004 | Frisch et al. | 383/103 |
| 7,270,245 | B2 * | 9/2007 | Cheng et al. | 220/62.1 |
| D694,588 | S * | 12/2013 | Tsai | D7/600.1 |
| 2005/0205578 | A1 * | 9/2005 | Yeh | 220/485 |
| 2008/0159659 | A1 * | 7/2008 | Liao et al. | 383/3 |

FOREIGN PATENT DOCUMENTS

| | | |
|---|---|---|
| TW | M396800 | 1/2011 |
| TW | M399838 | 3/2011 |

* cited by examiner

*Primary Examiner* — Anthony Stashick
*Assistant Examiner* — Robert Poon
(74) *Attorney, Agent, or Firm* — Muncy, Geissler, Olds & Lowe, P.C.

(57) ABSTRACT

An object carrying device includes a first net body, a frame, a front baffle panel, and a rear baffle panel. The first net body has a bottom portion and two lateral portions. The bottom portion has a front side, a rear side, and two opposing lateral sides. The two lateral portions extend from the two opposing lateral sides of the bottom portion, respectively, and face each other. The frame is clipped to the first net body and disposed at the outer periphery of the first net body. The front baffle panel is fixed to the frame and disposed between the front side of the bottom portion and the two lateral portions of the first net body. The rear baffle panel is fixed to the frame and disposed between the rear side of the bottom portion and the two lateral portions of the first net body.

7 Claims, 7 Drawing Sheets

OBJECT CARRYING DEVICE

BACKGROUND OF THE INVENTION

1. Technical Field

The present invention relates to iron wire furniture, and more particularly, to an object carrying device for carrying objects.

2. Description of Related Art

Taiwan utility models M396800 and M399838 disclose basket structures, respectively. Although the two patents disclose reinforcing the structures of the periphery of the mouths of the baskets, the two patents do not disclose reinforcing the structure of the body or bottom of the baskets. As a result, the meshwork of the baskets of M396800 and M399838 is susceptible to deformation.

SUMMARY OF THE INVENTION

The present invention provides an object carrying device. The object carrying device comprises a first net body, a frame, a front baffle panel, and a rear baffle panel. The first net body has a bottom portion and two lateral portions. The bottom portion has a front side, a rear side, and two opposing lateral sides. The two lateral portions extend from the two opposing lateral sides of the bottom portion, respectively, and face each other. The frame is clipped to the first net body and disposed at the outer periphery of the first net body. The front baffle panel is fixed to the frame and disposed between the front side of the bottom portion and the two lateral portions of the first net body. The rear baffle panel is fixed to the frame and disposed between the rear side of the bottom portion and the two lateral portions of the first net body.

Accordingly, compared with the prior art, the present invention provides an object carrying device that is lightweight, delicate, and sturdy.

BRIEF DESCRIPTION OF THE DRAWINGS

Technical features of the present invention are hereunder illustrated with a preferred embodiment in conjunction with the accompanying drawings, in which.

DETAILED DESCRIPTION OF THE EMBODIMENTS OF THE INVENTION

Figure 1:
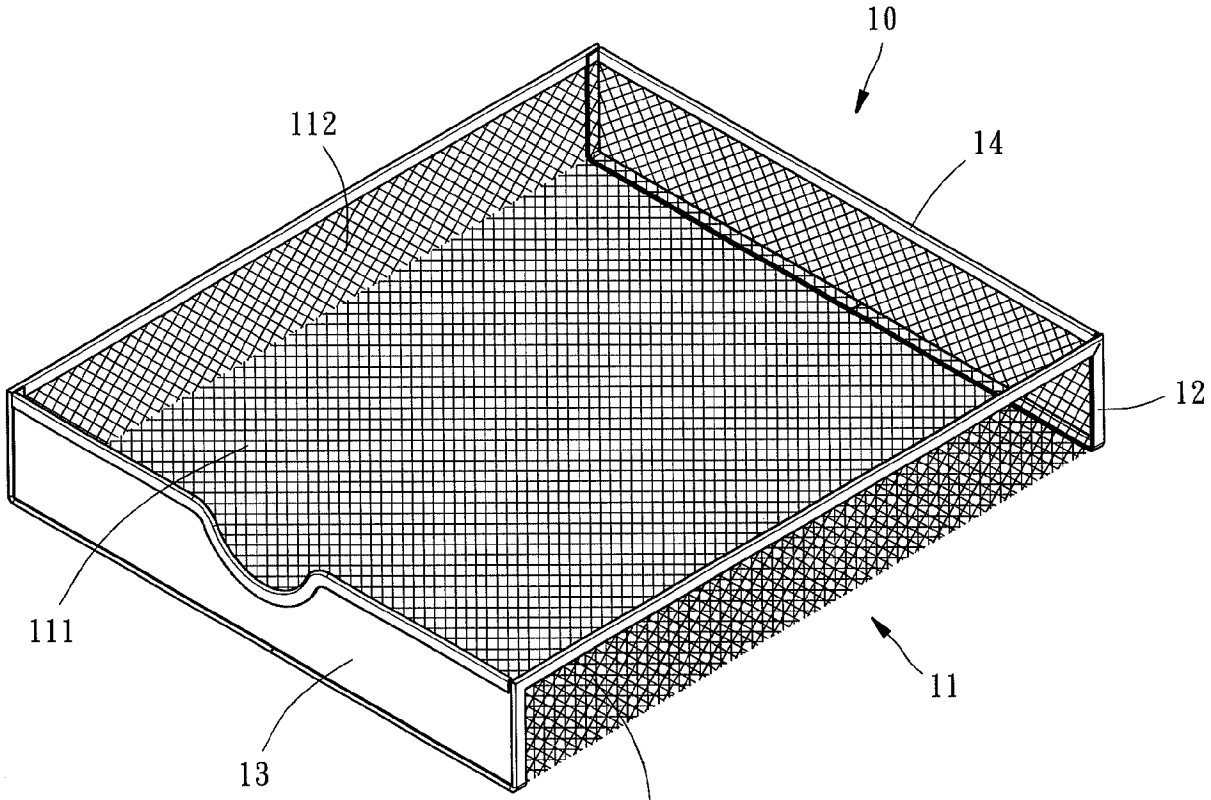
FIG. 1 is a perspective view of an object carrying device according to a preferred embodiment of the present invention.
Figure 2:
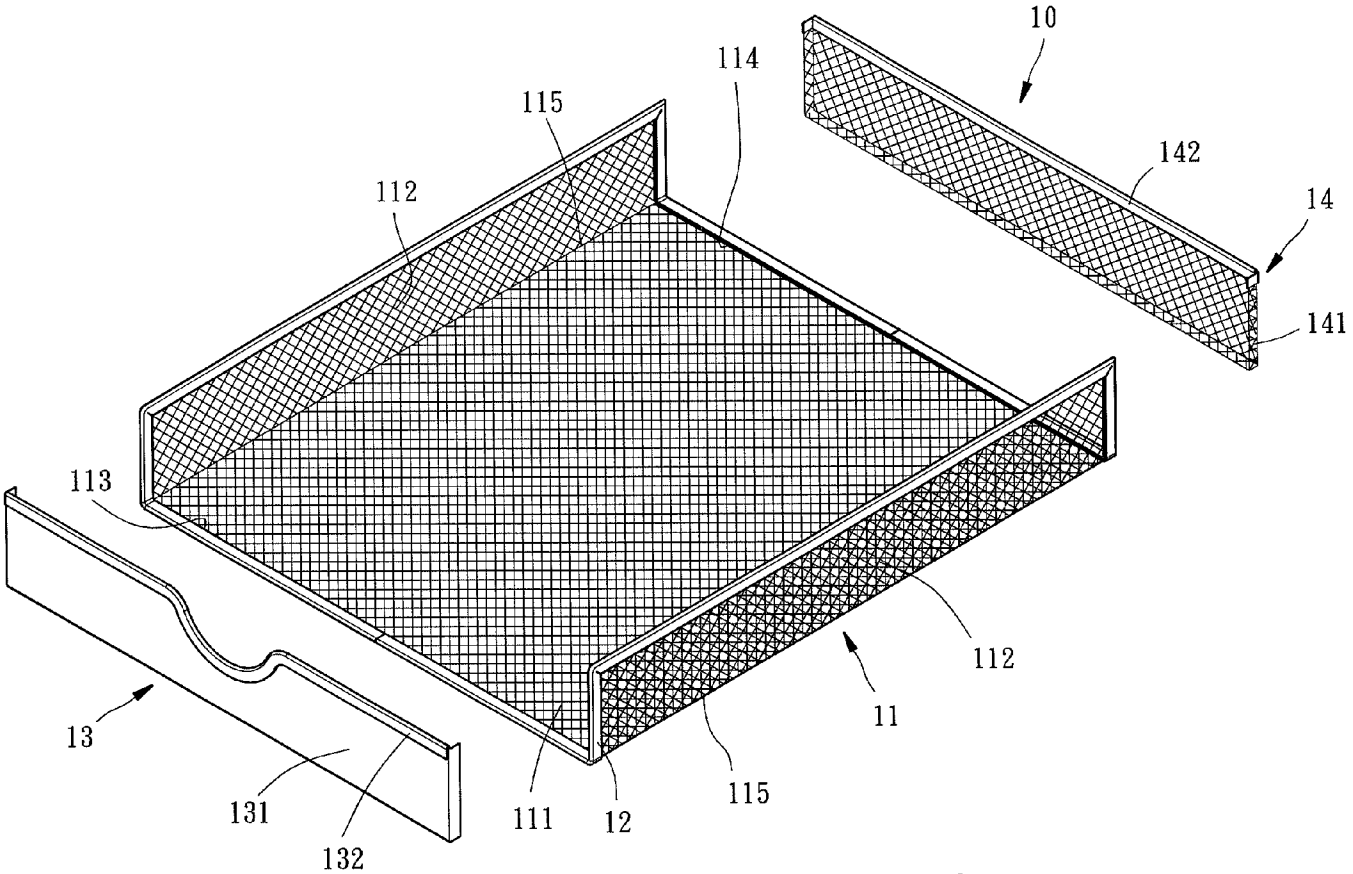
FIG. 2 is an exploded view of the object carrying device in FIG. 1.

Referring to FIG. 1 and FIG. 2, there are shown a perspective view and an exploded view of an object carrying device 10 according to a preferred embodiment of the present invention, respectively. The object carrying device 10 either functions as a drawer or is positioned on an object carrying rack or an exhibition cabinet that caters for storage-related needs, so as to store or carry a wide variety of articles or goods.

The object carrying device 10 comprises a first net body 11, a frame 12, a front baffle panel 13, and a rear baffle panel 14. The first net body 11 has a bottom portion 111 and two lateral portions 112. The bottom portion 111 has a front side 113, a rear side 114, and two opposing lateral sides 115. The two lateral portions 112 extend from the two opposing lateral sides 115 of the bottom portion 111, respectively, and face each other. Preferably, the first net body 11 is selectively a metallic net because it is bendable; hence, the shape of the first net body 11 can be readily formed by bending the metallic net as needed.

The frame 12 is clipped to the first net body 11 and disposed at the outer periphery of the first net body 11 to thereby reinforce the structure of the first net body 11 and prevent deformation of the first net body 11. Preferably, the frame 12 is selectively made of a metal or a material of high rigidity. Furthermore, with the frame 12 being disposed at the outer periphery of the first net body 11, the outer periphery of the first net body 11 is hidden and thus aesthetically pleasing.

The front baffle panel 13 is fixed to the frame 12 and disposed between the front side 113 of the bottom portion 111 and the two lateral portions 112 of the first net body 11. The rear baffle panel 14 is fixed to the frame 12 and disposed between the rear side 114 and the two lateral portions 112 of the bottom portion 111 of the first net body 11. Hence, the first net body 11, the front baffle panel 13, and the rear baffle panel 14 together define a receiving space for holding objects therein.

Figure 3:
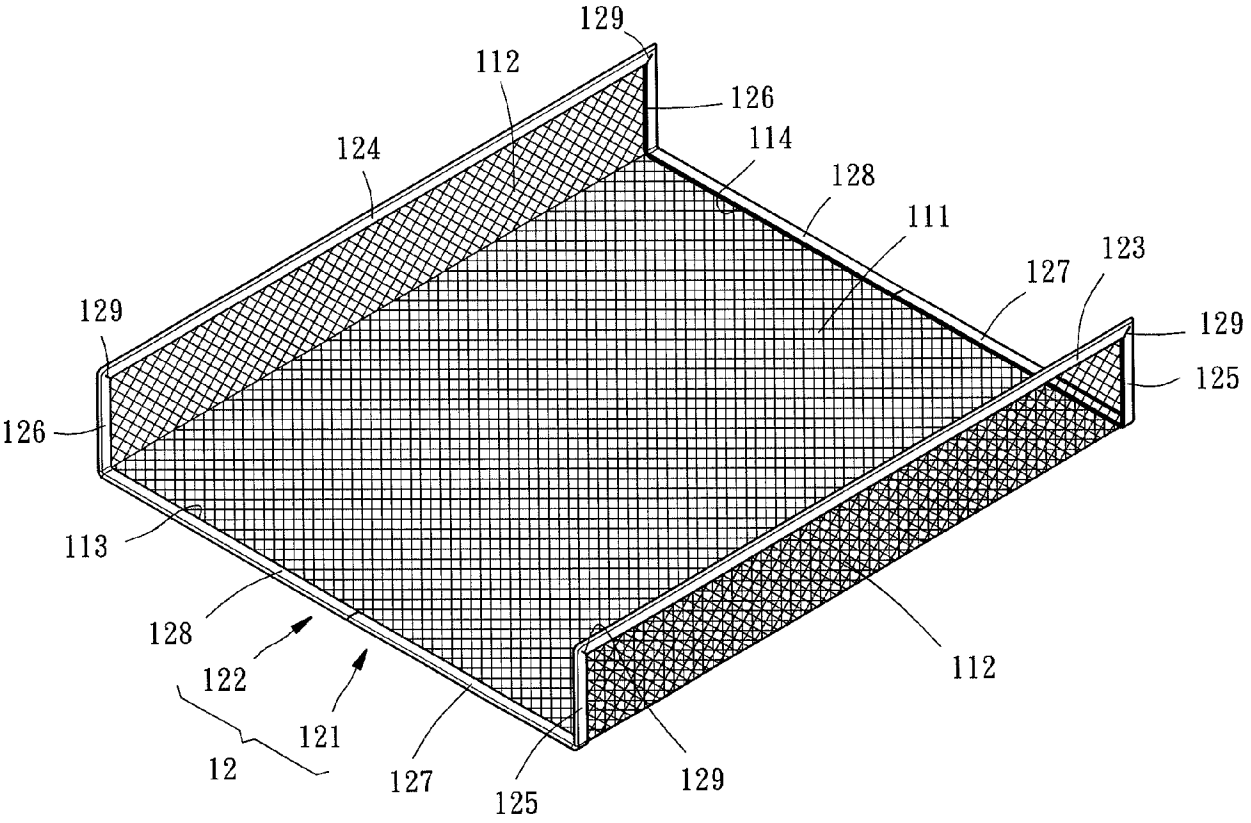
FIG. 3 is a schematic view of a first net body and a frame in FIG. 1.

Referring to FIG. 3, there is shown a schematic view of the first net body 11 and the frame 12. The frame 12 comprises two clip sheets 121, 122. Each clip sheet 121, 122 has a top section 123, 124, two upright sections 125, 126, and two bottom sections 127, 128. The tops of the two upright sections 125, 126 extend from front and rear ends of the top section 123, 124, respectively. The bottoms of the two upright sections 125, 126 extend from the two bottom sections 127, 128, respectively. The length of each top section 123, 124 equals the length of each long side of the two lateral portions 112 of the first net body 11. The length of each upright section 125, 126 equals the length of each lateral side of the two lateral portions 112. The length of each bottom section 127, 128 equals a half of the length of the front and rear sides 113, 114 of the first net body 11, indicating that the sum of the lengths of the adjoined bottom sections 127, 128 equals the length of the front side 113 and the length of the rear side 114 of the first net body 11. Hence, the outer periphery of the first net body 11 is reinforced by the two clip sheets 121, 122 disposed at the outer periphery of the first net body 11. To this end, it will also be feasible that the outer periphery of the first net body 11 is reinforced by one clip sheet only, as long as the total length of the clip sheet equals the sum of the lengths of the two clip sheets 121, 122.

Figure 4:
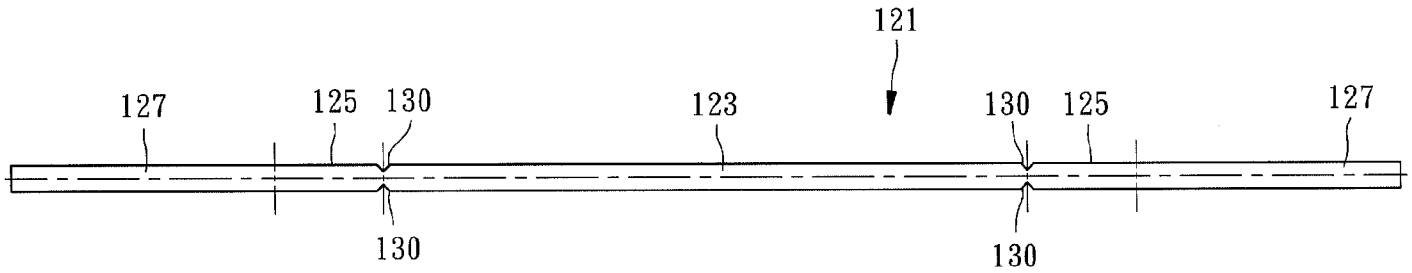
FIG. 4 and FIG. 5 are schematic views of two clip sheets, respectively.
Figure 5:
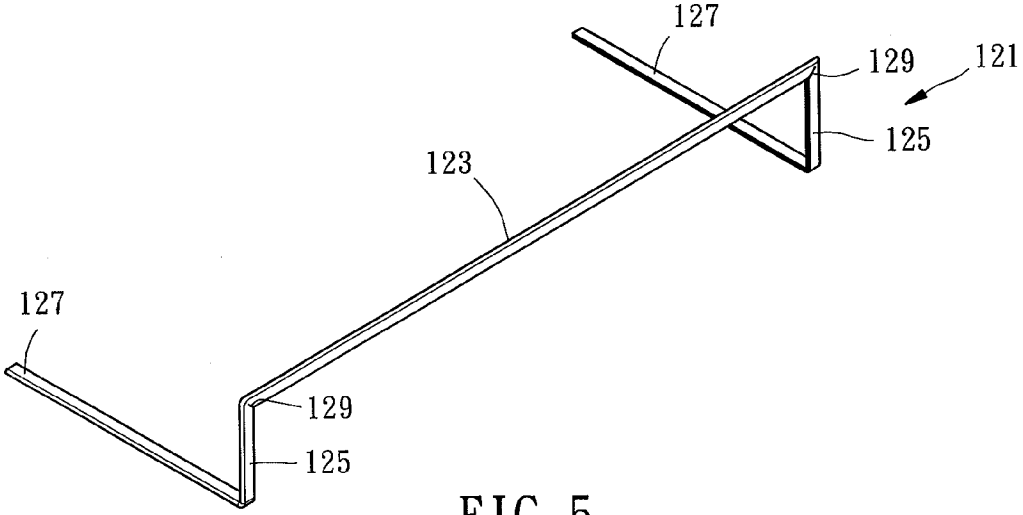

A gap 129 is formed between the top of each upright section 125, 126 and the top section 123, 124, and thus there is no remnant between the top of each upright section 125, 126 and the top section 123, 124 of the clip sheets 121, 122. Specifically speaking, referring to FIG. 4, there is shown a schematic view of the clip sheet 121 before being disposed at the outer periphery of the first net body. The clip sheet 121 is divided into the aforesaid top section 123, two upright sections 125, and two bottom sections 127. Four notches 130 are formed between the top section 123 and the two upright sections 125. Preferably, each of the notches 130 forms an included angle of 90 degrees. Referring to FIG. 5, there is shown a schematic view of the clip sheet 121 bent in a bilaterally symmetrical manner. The gaps 129 are spontaneously formed between the top section 123 and each of the tops of the two upright sections 125. The gap 129 is formed by abutting two adjacent said notches 130 against each other.

Referring to FIG. 2, the rear baffle panel 14 comprises a second net body 141 and a rear slat 142. Two lateral sides and a bottom side of the second net body 141 are fixed to the frame 12 and disposed between the rear side 114 of the bottom portion 111 and the two lateral portions 112 of the first net body 11. Preferably, the second net body 141 is fixed in place by spot welding or adhesion. The rear slat 142 is clipped to the top side of the second net body 141. Two terminal ends of the rear slat 142 are fixed to the frame 12 and disposed at the two lateral portions 112 of the first net body 11. Hence, with the rear slat 142 being fixed to the top side of the second net body 141, the structure between the frame 12 and the top side the second net body 141 is reinforced.

The front baffle panel 13 comprises a front panel 131 and a front slat 132. Two lateral sides and a bottom side of the front panel 131 are fixed to the frame 12 and disposed between the front side 113 of the bottom portion 111 and the two lateral portions 112 of the first net body 11. The front slat 132 is coupled to the top side of the front panel 131. Preferably, the front panel 132 is fixed to the frame 12 by spot welding or adhesion. In practice, it is also feasible to dispense with the front slat 132.

Furthermore, it is feasible that the front baffle panel 13 is structurally identical to the rear baffle panel 14; that is to say, the front baffle panel 13 has a third net body and a front slat, wherein the third net body is the same as the second net body, and the front slat is the same as the rear slat. The major difference between the front baffle panel 13 and the rear baffle panel 14 lies in position. The two lateral sides and the bottom side of the third net body are fixed to the frame and disposed between the front side of the bottom portion and the two lateral portions of the first net body. The front slat is clipped to the top side of the third net body. The two terminal ends of the front slat are fixed to the frame and disposed at the two lateral sides of the first net body. The front baffle panel 13 and the rear baffle panel 14 are of the same structure, for example, with a net body clipped to slats, or are of different structures. The structures of the front baffle panel 13 and the rear baffle panel 14 are designed as needed and are not restricted to the preferred embodiment.

Figure 6:
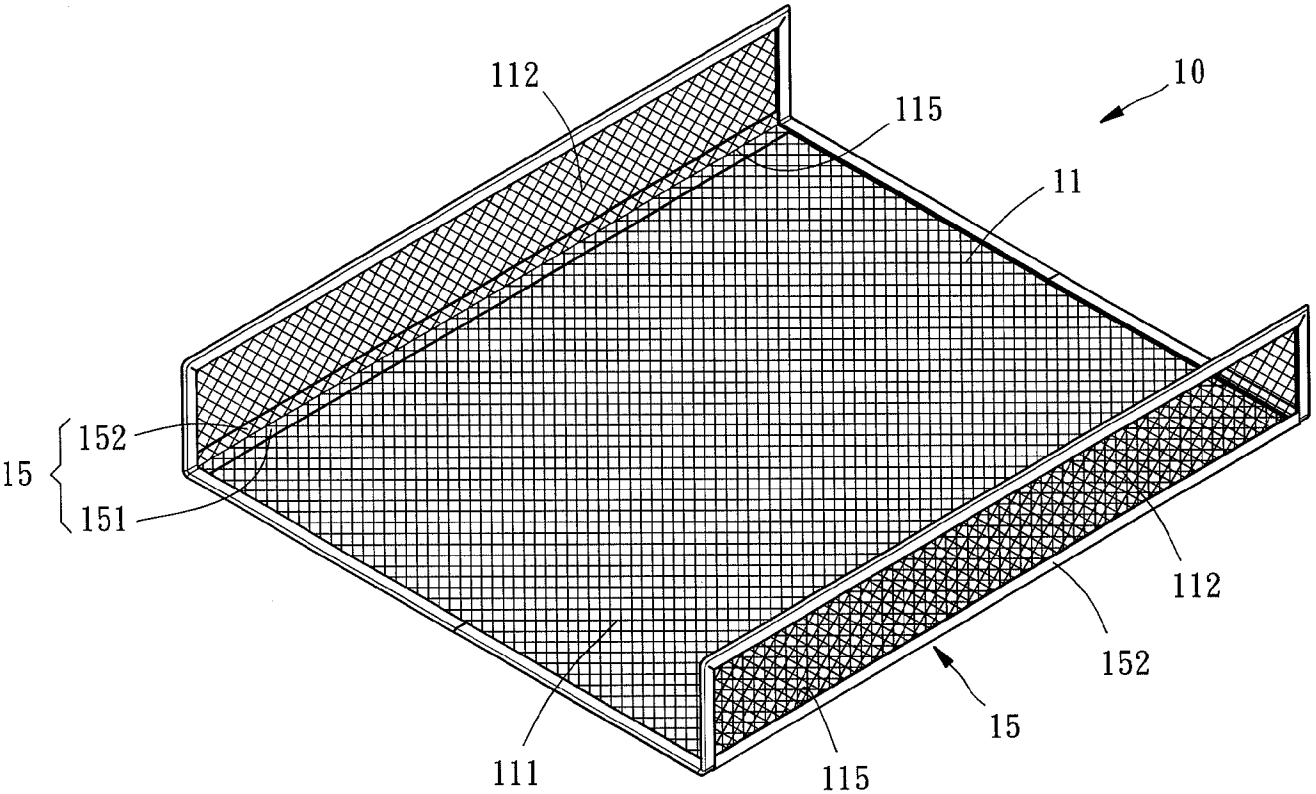
FIG. 6 is a schematic view of two supporting units disposed on the first net body.

Referring to FIG. 6, there is shown a schematic view of two supporting units disposed on the first net body. The object carrying device 10 further comprises two supporting units 15. Each supporting unit 15 has a bottom panel 151 and an upright panel 152 extending from a lateral side of the bottom panel 151. The two bottom panels 151 abut against two sides of the bottom portion 111 of the first net body 11, respectively. The two upright panel 152 abuts against the two lateral portions 112 of the first net body 11. Hence, bends of the first net body 11 are structurally reinforced to prevent deformation of the bends of the first net body 11.

Figure 7:
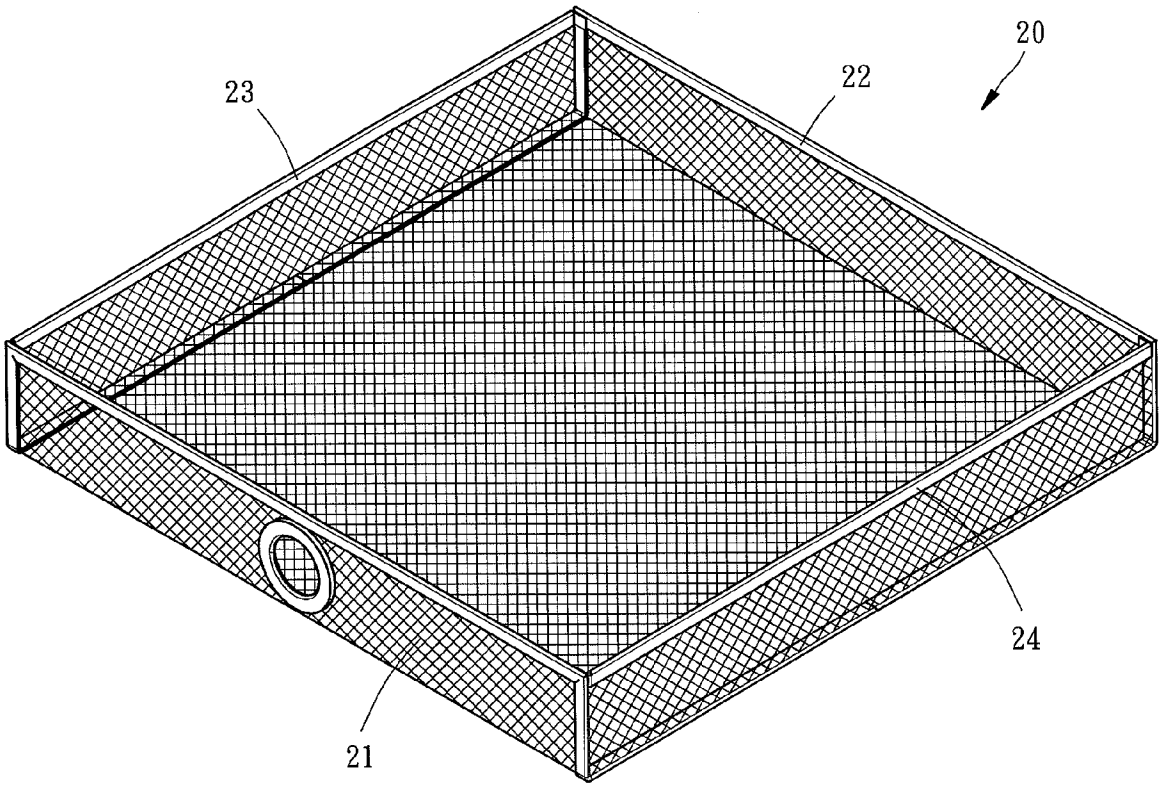
FIG. 7 and FIG. 8 are schematic views of an object carrying device according to another preferred embodiment of the present invention.
Figure 8:
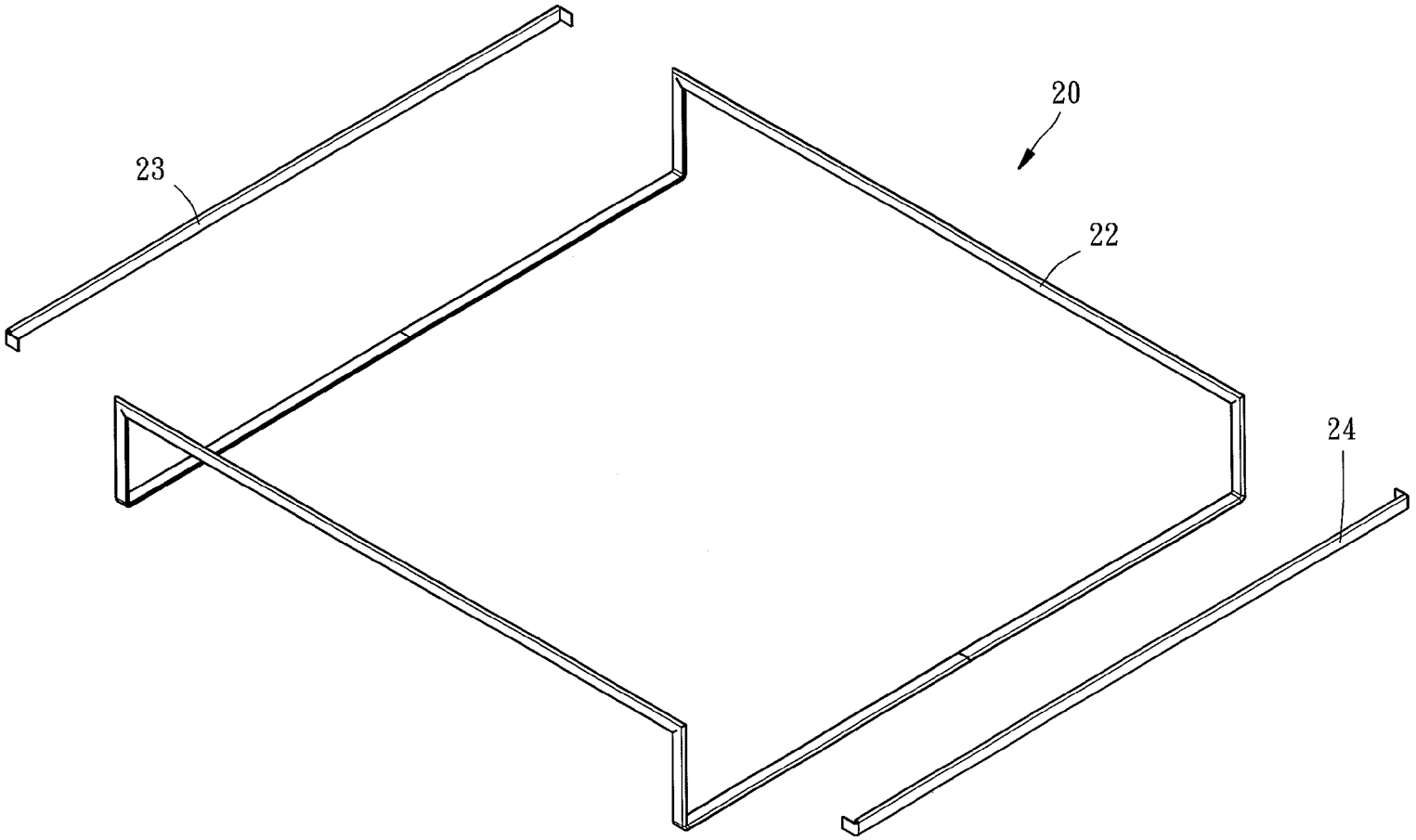

Referring to FIG. 7 and FIG. 8, there are shown schematic views of an object carrying device 20 according to another preferred embodiment of the present invention. FIG. 8 omits a first net body, a net body of a front baffle panel, and a net body of a rear baffle panel. The object carrying device 20 is substantially identical to the object carrying device 10 in terms of structure. As shown in the diagrams, the major difference lies in that: the object carrying device 20 of FIG. 7 differs from the object carrying device 10 of FIG. 1 by 90 degrees clockwise. A front baffle panel 23 and a rear baffle panel 24 of the object carrying device 20 are of the same structure, and are not described in detail herein for the sake of brevity. For more details of the front baffle panel 23 and the rear baffle panel 24 of the object carrying device 20, please make reference to the above description of the front baffle panel 13 and the rear baffle panel 14. A first net body 21 and a frame 22 are identical to the first net body 11 and the frame 12, respectively, and thus are not described in detail herein for the sake of brevity. A point to note is that the object carrying device 20 dispenses with the aforesaid two supporting units, and thus the two supporting units 15 shown in FIG. 6 can be dispensed with.

What is claimed is:

1. An object carrying device, comprising:

a first net body bent to form a bottom portion and two lateral portions, the bottom portion having a front side, a rear side, and two opposing lateral sides, the two lateral portions extending from the two opposing lateral sides of the bottom portion, respectively, and facing each other, the first net body continuously forming the bottom portion and the two lateral portions such that the first net body forms an edge of the object carrying device between the bottom portion and each of the two lateral portions;

a frame clipped to the first net body and disposed at an outer periphery of the first net body;

a front baffle panel fixed to the frame and disposed at the front side of the bottom portion of the first net body; and a rear baffle panel fixed to the frame and disposed at the rear side of the bottom portion of the first net body, wherein the frame comprises two clip sheets each bent to form a top section, two upright sections, and two bottom sections, wherein a length of each top section equals a length of each long side of the two lateral portions of the first net body, wherein a length of each upright section equals a length of each lateral side of the two lateral portions, wherein a length of each bottom section equals a half of the length of the front and rear sides of the first net body.

2. The object carrying device of claim 1, wherein a gap is formed between the top of each upright section and the top section.

3. The object carrying device of claim 1, wherein the rear baffle panel comprises a second net body and a rear slat, wherein two lateral sides and a bottom side of the second net body are fixed to the frame, wherein the rear slat is clipped to a top side of the second net body, wherein two terminal ends of the rear slat are fixed to the frame.

4. The object carrying device of claim 3, wherein the front baffle panel comprises a third net body and a front slat, wherein two lateral sides and a bottom side of the third net body are fixed to the frame, wherein the front slat is clipped to a top side of the third net body, and two terminal ends of the front slat are fixed to the frame.

5. The object carrying device of claim 3, wherein the front baffle panel comprises a front panel and a front slat, wherein two lateral sides and a bottom side of the front panel are fixed to the frame, the front slat being coupled to a top side of the front panel.

6. The object carrying device of claim 1, wherein the front baffle panel comprises a front panel and a front slat, wherein two lateral sides and a bottom side of the front panel are fixed to the frame, the front slat being coupled to a top side of the front panel, wherein the rear baffle panel comprises a rear panel and a rear slat, wherein two lateral sides and a bottom side of the rear panel are fixed to the frame, wherein the rear slat being coupled to a top side of the rear panel.

7. The object carrying device of claim 1, further comprising two supporting units each having a bottom panel and an upright panel extending from a lateral side of the bottom panel, the two bottom panels abutting against two sides of the bottom portion of the first net body, respectively, and the two upright panels abutting against the two lateral portions of the first net body, respectively.

* * * * *